US008082853B2

(12) United States Patent
Heil et al.

(10) Patent No.: US 8,082,853 B2
(45) Date of Patent: Dec. 27, 2011

(54) HOLD-DOWN DEVICE FOR THE CABLE GUIDE IN CABLE-DRAWN TRANSPORT SYSTEMS

(75) Inventors: Ernst Heil, Vienna (AT); Herbert Willim, Stockerau (AT); Lothar Busemann, Brixen (IT)

(73) Assignee: High Technology Investments B.V., Leimuiden (NL)

( * ) Notice: Subject to any disclaimer, the term of this patent is extended or adjusted under 35 U.S.C. 154(b) by 1192 days.

(21) Appl. No.: 10/543,743

(22) PCT Filed: Jan. 15, 2004

(86) PCT No.: PCT/IB2004/000070

§ 371 (c)(1), (2), (4) Date: Jan. 22, 2008

(87) PCT Pub. No.: WO2004/067347

PCT Pub. Date: Aug. 12, 2004

(65) Prior Publication Data

US 2008/0115689 A1 May 22, 2008

(30) Foreign Application Priority Data

Jan. 30, 2003 (IT) ..... BZ2003A0005

(51) Int. Cl.
*B61B 7/00* (2006.01)

(52) U.S. Cl. ..... 104/197; 104/112; 104/113; 104/202; 105/30; 105/32

(58) Field of Classification Search ..... 104/112, 104/113, 115, 173.1, 202, 229, 230–234, 104/238; 105/30, 32, 33, 73
See application file for complete search history.

(56) References Cited

U.S. PATENT DOCUMENTS

| | | | | |
|---|---|---|---|---|
| 472,211 | A | 4/1892 | Fralinger | |
| 1,944,446 | A | 1/1934 | McGowen | |
| 2,662,587 | A | 12/1953 | McIlvaine | |
| 2,710,650 | A | 6/1955 | Sowder | |
| 2,985,224 | A | 5/1961 | Sowder | |
| 3,170,412 | A | 2/1965 | Sowder | |
| 3,859,926 | A * | 1/1975 | Strohschein | 104/178 |
| 3,934,517 | A * | 1/1976 | Hirsig | 104/173.1 |
| 4,185,562 | A * | 1/1980 | Hatori et al. | 105/152 |

(Continued)

FOREIGN PATENT DOCUMENTS

| | | |
|---|---|---|
| AT | 315 390 | 6/1974 |

(Continued)

*Primary Examiner* — Joe Morano, IV
*Assistant Examiner* — Jason C Smith
(74) *Attorney, Agent, or Firm* — K&L Gates LLP

(57) ABSTRACT

A pressure device for conduction of the cable in cable traction transportation systems including a pressure-roller (12) of the cable (7) supported elastically on a fixed support (2) and a counter-roller (6) supported on the fixed support (2) is described. In accordance with this invention the counter-roller (6) is supported in a revolving manner on a roller-holder (5) articulated at one end to the fixed support (2) and possesses at the other end guide means (8, 9) that engage as a running guide an arm (10) that bears in a revolving manner at one end the pressure-roller (12) on the side opposite the counter-roller (6) and is articulated at the other end to the fixed support (2) with the arm (10) being pressed by elastic means in the direction of exertion of pressure of the pressure-roller (12) on the cable (7).

6 Claims, 2 Drawing Sheets

U.S. PATENT DOCUMENTS

Figure 1:
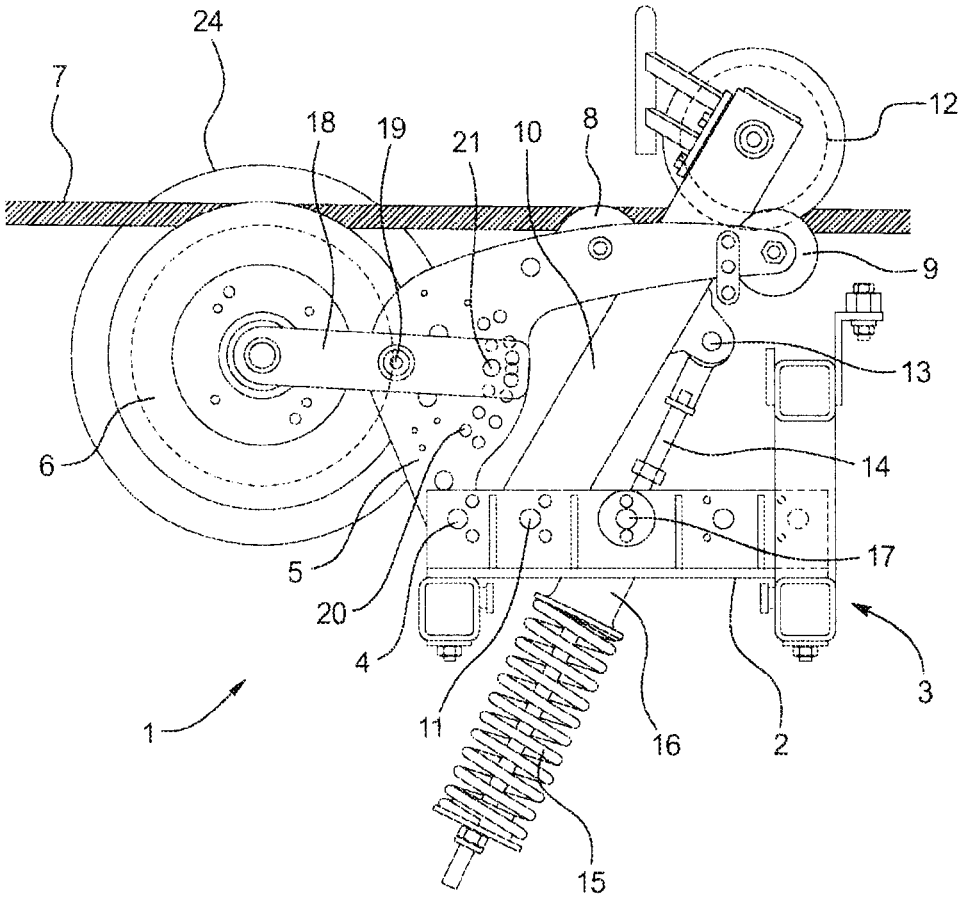

| | | | | |
|---|---|---|---|---|
| 4,226,187 | A | 10/1980 | Paulsen et al. | |
| 4,269,123 | A | 5/1981 | Segafredo | |
| 4,280,411 | A | 7/1981 | Katayose et al. | |
| 4,462,314 | A | 7/1984 | Kuncaynski | |
| 4,470,355 | A | 9/1984 | Kunczynski | |
| 4,473,011 | A | 9/1984 | Wuschek | |
| 4,640,197 | A | 2/1987 | Brian | |
| 4,641,587 | A | 2/1987 | Dalliard | |
| 4,671,187 | A | 6/1987 | Kunczynski | |
| 4,833,997 | A | 5/1989 | Cathiard | |
| 4,898,100 | A | 2/1990 | Brochand | |
| 5,107,771 | A | 4/1992 | Kainz | |
| 5,113,768 | A | 5/1992 | Brown | |
| 5,226,368 | A | 7/1993 | Brochand et al. | |
| 5,515,789 | A | 5/1996 | Brochand et al. | |
| 5,562,040 | A | 10/1996 | Egli | |
| 5,582,109 | A | 12/1996 | Levi et al. | |
| 5,595,122 | A | 1/1997 | Levi et al. | |
| 6,036,282 | A | 3/2000 | Clarke et al. | |
| 6,321,658 | B1 * | 11/2001 | Pabst et al. | 104/202 |
| 6,345,578 | B1 | 2/2002 | Pabst | |
| 6,543,366 | B2 * | 4/2003 | Pabst et al. | 104/202 |
| 6,585,232 | B2 | 7/2003 | Rechenmacher | |
| 7,404,360 | B2 * | 7/2008 | Cylvick | 104/112 |
| 7,410,068 | B1 * | 8/2008 | Andreetto | 212/94 |
| 7,549,377 | B2 * | 6/2009 | Pabst | 104/180 |
| 7,637,213 | B2 * | 12/2009 | Cylvick | 104/112 |
| 7,640,863 | B2 * | 1/2010 | Minges | 104/130.03 |
| 7,650,843 | B2 * | 1/2010 | Minges | 104/178 |
| 7,891,300 | B2 * | 2/2011 | Pabst et al. | 104/178 |
| 2002/0026839 | A1 | 3/2002 | Lehtovaara | |
| 2002/0088368 | A1 | 7/2002 | Pabst et al. | |
| 2006/0249718 | A1 | 11/2006 | Levi | |
| 2006/0288901 | A1 * | 12/2006 | Cylvick | 104/112 |
| 2007/0169660 | A1 * | 7/2007 | Pabst | 104/196 |
| 2008/0115689 | A1 * | 5/2008 | Heil et al. | 104/242 |
| 2009/0165666 | A1 * | 7/2009 | Pabst et al. | 104/112 |
| 2009/0165668 | A1 | 7/2009 | Andreetto | |
| 2010/0300322 | A1 * | 12/2010 | Cylvick | 104/112 |

FOREIGN PATENT DOCUMENTS

| | | |
|---|---|---|
| AT | 342 655 | 4/1978 |
| AT | 373 832 | 2/1984 |
| AT | 388146 | 5/1989 |
| AT | 390 926 | 7/1990 |
| CH | 259291 | 1/1949 |
| CH | 360 704 | 3/1962 |
| CH | 554761 | 10/1974 |
| DE | 423 865 | 1/1926 |
| DE | 2 020 746 | 12/1971 |
| DE | 2101743 | 9/1972 |
| DE | 3109294 | 10/1982 |
| DE | 3 834 116 | 5/1989 |
| DE | 3 927 757 | 3/1991 |
| DE | 4127373 | 2/1993 |
| EP | 0055955 | 7/1982 |
| EP | 0135239 | 3/1985 |
| EP | 0 218 306 | 4/1987 |
| EP | 0 218 897 | 4/1987 |
| EP | 0281205 | 9/1988 |
| EP | 0491632 | 6/1992 |
| EP | 0517622 | 12/1992 |
| EP | 0613807 | 9/1994 |
| EP | 0640518 | 3/1995 |
| EP | 0678433 | 10/1995 |
| EP | 0687607 | 12/1995 |
| EP | 0692418 | 1/1996 |
| EP | 0 745 526 | 12/1996 |
| EP | 0 970 864 | 1/2000 |
| EP | 1077167 | 2/2001 |
| EP | 1088729 | 4/2001 |
| EP | 1174323 | 1/2002 |
| EP | 1195305 | 4/2002 |
| EP | 1 209 055 | 5/2002 |
| EP | 1331151 | 7/2003 |
| EP | 1364853 | 11/2003 |
| EP | 1419950 | 5/2004 |
| FR | 891743 | 3/1944 |
| FR | 913146 | 8/1946 |
| FR | 1100001 | 9/1955 |
| FR | 1 199 721 | 12/1959 |
| FR | 1 423 648 | 1/1966 |
| FR | 2 387 830 | 11/1978 |
| FR | 2 391 450 | 12/1978 |
| FR | 2 392 858 | 12/1978 |
| FR | 2 340 895 | 9/1979 |
| FR | 2562857 | 10/1985 |
| FR | 2 670 452 | 6/1992 |
| FR | 2 706 404 | 12/1994 |
| FR | 2 823 482 | 10/2002 |
| FR | 2867142 | 9/2005 |
| GB | 1326264 | 8/1973 |
| GB | 1 353 030 | 5/1974 |
| GB | 1460106 | 12/1976 |
| GB | 2017024 | 9/1979 |
| WO | WO2004085221 | 10/2004 |
| WO | WO2005032901 | 4/2005 |
| WO | WO2008020021 | 2/2008 |
| WO | WO2008129017 | 10/2008 |
| WO | WO2008129019 | 10/2008 |
| WO | WO2009019259 | 2/2009 |
| WO | WO2009053485 | 4/2009 |

* cited by examiner

HOLD-DOWN DEVICE FOR THE CABLE GUIDE IN CABLE-DRAWN TRANSPORT SYSTEMS

This invention relates to a pressure device for cable conduction in cable traction transportation systems in accordance with the classifying part of claim 1.

In case of cable traction transportation systems in which traction cable conduction must meet the requirements through conduction of the path with horizontal as well as vertical path radii, sometimes special roller constructions are necessary. A main requirement is that the cable vice that connects the mobile vehicle (FBM) with the pulling cable detach the cable from the rollers in the passage and that the cable then be safely deposited in the roller again.

In the case of a vertical concave deviation of the cable, fixed pressure-rollers that prevent unacceptable detachment of the cable in this path section are required. The position of the cable in the roller is measurement δ vertically higher than the cable position in the cable vice. Upon passage of the cable vice through the pressure-roller, the cable, which lies in the cable vice mouth, is detached downward from the pressure-roller and thus allows passage of the vice mouth beneath the respective roller. A counter-roller, likewise applied there with the necessary guidance of the spring and with load-bearing roller function and which in the absence of a vehicle and through a helical compression spring presses the cable with a definite force against the pressure-roller and thus represents a safety against derailment of the cable in case of unusual oscillations of the cable upon passage of the vehicle and overcoming correspondingly the elastic force of the helical compression spring, deviates downward and thus allows passage of the vice mouth above the rollers.

If in case of conduction of the path between vertical concave deviation of the cable and then horizontal deviation of the cable there are only short distances, then the measurement δ has vertically a not negligible influence on the conduction of the cable of the first rollers in the horizontal deviation section of the cable since the cable is also detached from the horizontal rollers upon passage of the vehicle. If the horizontal section is present for example in a slope of x % of the path, with detachment of the cable from the horizontal roller with simultaneous deposit of the cable in the pressure-roller (vertical movement of the cable by the measurement delta=δ) as also of a vehicle traveling valleyward (vertical movement of the vice cable) it could happen that the cable could no longer be deposited in the horizontal roller of the cable.

The general purpose of this invention is to reduce the measurement δ of the vertical movement of the cable in the pressure-roller zone. But this means that in case of a size of the vice (in particular in the vice mouth zone) reduced by reason of the forces occurring already at a minimum, that not only the counter-roller upon passage of the vehicle escapes the vice mouth downward but the pressure-roller also escapes the vice mouth upward. Thus the measurement 8 can be effectively reduced to the measurement necessary and simultaneously the free space necessary for the vice mouth upon passage of the vehicle can be assured. This purpose is achieved in accordance with this invention by a pressure device for conduction of the cable in cable traction transportation systems with the characterizing characteristics of claim 1.

The vertical movement of the counter-roller upon passage of the vehicle is coupled with the necessary vertical movement of the pressure-roller though the roller-holder of the counter-roller. The roller-holder has respective members that accompany the revolving arm of the pressure-roller in the movement.

The helical compression spring including the spring guide is connected directly with the pressure-roller.

The roller-holder of the counter-roller, the pressure-roller and the spring guide have respectively separate points of rotation on the support that in turn is the connection with the framework.

Owing to the right choice of the rotation points and of a respective force of the compression spring, which is adjustable, the total system finds a balance of forces that depends on the agent deviation force of the cable. This balance of forces can be adjusted so that the measurement δ can be effectively reduced.

In the absence of a vehicle, the pressure-roller and the counter-roller are in direct contact with the cable. The compression spring including the spring guide presses the pressure-roller with a definite force on the cable. The roller-holder has an adjustment capability with which the counter-roller can be adjusted and hence has available a respective pressure on the roller.

Upon passage of the vehicle the counter-roller is pressed downward by the cable. Due to its coupling with the pressure-roller the roller-holder entails that the latter move upward from rotation around the rotation point and hence that the free space necessary for passage of the vice be formed between the counter-roller and the pressure-roller. This movement entails an increase in the elastic force of the compression spring observed relative to the assembly situation and in the absence of the vehicle.

If the vehicle has traversed the counter-roller point, then on the basis of the force of the compression spring and the recall torque, hence present, positioning in the initial position takes place.

Any oscillations can be compensated for if necessary by a vibration damper.

The counter-roller has as redundant safety a conical pulley applied laterally that could serve as aid for a new deposit of the cable in the correct position. The pressure-roller has as redundant safety a corresponding bracket that could prevent resting of the cable above the pressure-roller.

The roller-holder has available a redundant safety (redundant coupling) for the case of loss of coupling provided for operation.

Figure 2:
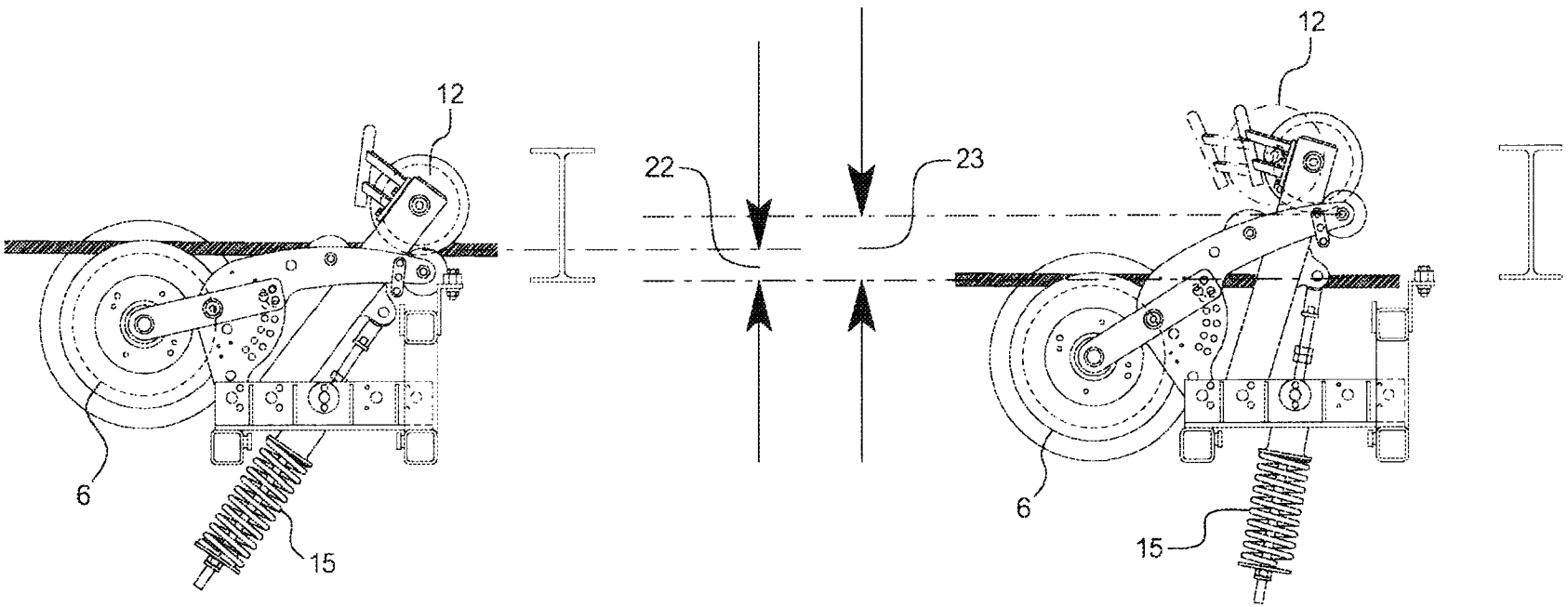

Additional details and characteristics of the pressure device for conduction of the cable in cable traction transportation systems are given in the claims and the following description of a preferred embodiment shown in the drawing showing:

FIG. 1 shows a diagrammatic side view of a pressure device in accordance with this invention, and FIG. 2 shows the active system of the rollers and of reduction of the δ measurement; to the left in the absence of a vehicle, to the right upon the state of passage of a vehicle (operated), and in case of a fixed pressure-roller it would always be in the upper position shown.

With reference to the figures, FIG. 1 shows overall a pressure device in accordance with this invention for conduction of the cable in cable traction transportation systems. It includes a support 2 that is fastened to a structure 3 of a cable traction vehicle system. To one rotation point 4 of the support 2 there is jointed a roller-holder 5 that bears in a revolving manner at a distance from the rotation point 4 a counter-roller 6 on which the cable 7 goes to rest. On an angled extension of the roller-holder 5 a guide roller 8 is supported and, at a distance from it, a guide roller 9 that receive as a guide running between them an arm 10.

The arm 10 is jointed at one end at a rotation point 11 to the roller-holder 5 and carries in a revolving manner at its other end a pressure-roller 12.

At a distance from the rotation point 11 of the arm 10 at an articulated joint 13 is located a tie rod 14 that loads in known manner a compression roller 15 in a guide 16 that is jointed at a rotation point 17 to the support 2.

For adjustment of the position of the counter-roller 6 relative to the roller-holder 5 the counter-roller 6 is supported in a revolving manner at one end of a lever 18 that is articulated around a rotation point 19 to the roller-holder 5. The other end of the lever 18 can be locked in holes 20 by fastening pins 21. For this purpose the holes 20 are arranged along an arc of a circle so that the lever 18 is adjustable at regular preset distances around the rotation point 19.

With the application of a laterally applied conical pulley 24 to the counter-roller 6 a guide with stress raiser depositing the cable in the correct position is created. Naturally the above description of an embodiment applying the innovative principles of this invention is given by way of non-limiting example of said principles within the scope of the exclusive right claimed here. For example, instead of the compression spring there can be provided any other elastic means as well as for example a hydraulic cylinder. The guide rollers of the roller-holder operated by the counter-roller can be replaced by running guides of any type.

The invention claimed is:

1. Pressure device for conduction of the cable in cable traction transportation systems including:

a pressure-roller that can engage a cable;

a fixed support that elastically supports the pressure roller;

a counter-roller supported on the fixed support and characterized in that the counter-roller being supported in a revolving manner on a roller-holder articulated at one end to the fixed support, another end of the roller holder possessing guide means;

an arm that bears in a revolving manner at one end the pressure-roller on a side opposite the counter-roller and that is engaged as a running guide by the guide means;

the roller holder being articulated at another end to the fixed support;

elastic means arranged such that the arm is pressed by elastic means in a direction of exertion of pressure of the pressure-roller on the cable.

2. Pressure device in accordance with claim 1 characterized in that the elastic means include a compression spring.

3. Pressure device in accordance with claim 2 further comprising a tie rod located at an articulation of the arm at a particular distance from a rotation point of the arm, the compression spring is in a guide articulated at a rotation point to the support, and the tie rod loads the compression spring in a known.

4. Pressure device in accordance with claim 1 characterized in that the elastic means include a hydraulic cylinder.

5. Pressure device in accordance with claim 1 further comprising a lever articulated around a rotation point to the roller holder, one end of the lever supporting the counter-roller in a revolving manner, another end of the lever comprising holes arranged along an arc of a circle such that the lever is adjustable at preset angular distances about the rotation point, the lever further being lockable by means of fastening pins in the holes.

6. Pressure device in accordance with claim 1 further comprising a conical pulley applied laterally on the counter-roller to tension the cable upon deposit of the cable in a correct position.

* * * * *